US008230524B1

(12) United States Patent
Safford

(10) Patent No.: US 8,230,524 B1
(45) Date of Patent: Jul. 31, 2012

(54) GLOVE WITH RETRACTABLE CLOSURE

(75) Inventor: Kenny Safford, Simi Valley, CA (US)

(73) Assignee: Mechanix Wear, Inc., Valencia, CA (US)

( * ) Notice: Subject to any disclaimer, the term of this patent is extended or adjusted under 35 U.S.C. 154(b) by 138 days.

(21) Appl. No.: 12/844,140

(22) Filed: Jul. 27, 2010

(51) Int. Cl.
*A41D 19/00* (2006.01)

(52) U.S. Cl. ..... 2/162; 2/161.4; 2/917

(58) Field of Classification Search ..... 2/16, 20, 2/161.1–163, 27, 170, 912, 917
See application file for complete search history.

(56) References Cited

U.S. PATENT DOCUMENTS 4,651,345 A * 3/1987 Latina ..... 2/19
4,730,354 A * 3/1988 Saito ..... 2/161.2
4,962,547 A * 10/1990 Minnick ..... 2/161.4
5,197,149 A * 3/1993 Overton ..... 2/162
5,457,819 A * 10/1995 Aoki ..... 2/19
5,528,773 A 6/1996 Lowinger
6,199,209 B1 * 3/2001 Aoki ..... 2/19
6,286,148 B1 * 9/2001 Meyer ..... 2/161.1
7,275,267 B2 * 10/2007 Thiruppathi ..... 2/161.1
7,895,671 B2 * 3/2011 Salomon ..... 2/161.2

* cited by examiner

*Primary Examiner* — Danny Worrell, Jr.
(74) *Attorney, Agent, or Firm* — Eric Karich

(57) ABSTRACT

A glove has a glove body and a closure mechanism. The glove body has a palm portion and a back portion that together define an interior. A cuff perimeter defines an opening to the interior, and an access slit extends from the cuff perimeter to enable the opening to expand. The closure mechanism includes an inner layer adjacent the glove body that forms a band compartment having an exit slot. An elastic band is positioned within the band compartment, with a first end attached to the band compartment and a second end that extends out through the exit slot. A first fastener element is positioned on the second end of the elastic band, and a second fastener element adapted to removably engage the first fastener element is attached to the glove body on the opposite side of the access slit from the exit slot.

4 Claims, 2 Drawing Sheets

GLOVE WITH RETRACTABLE CLOSURE

BACKGROUND OF THE INVENTION

1. Field of the Invention

This invention relates generally to gloves, and more particularly to a glove having a retractable closure system.

2. Description of Related Art

Various glove closure systems have been devised for closing a glove around the hand of a user, to prevent the glove from coming off during work. A most common design includes a Velcro strap that may be used to tighten and close the gloves around the user's hand. The problem with this design is that the strap remains hanging when not in use.

Lowinger, U.S. Pat. No. 5,528,773, teaches a glove that includes a flap closure that utilized Velcro for fastening the flap closure to the glove. The flap closure is used to secure the glove around the hand of the user, to prevent the glove from coming off during use. This reference is hereby incorporated by reference in full.

The prior art teaches gloves that use a flap closure to secure a glove closed around a user's hand. However, the prior art does not teach a glove that includes a closure system that retracts into the glove when not being used. The present invention fulfills these needs and provides further related advantages as described in the following summary.

SUMMARY OF THE INVENTION

The present invention teaches certain benefits in construction and use that give rise to the objectives described below.

The present invention provides a glove having a glove body and a closure mechanism. The glove body has a palm portion and a back portion that together define an interior. A cuff perimeter defines an opening for accessing the interior of the glove body. An access slit extends from the cuff perimeter to enable the opening to expand from a closed configuration to an expanded configuration. An inner layer adjacent the glove body and the glove perimeter together form a band compartment. The closure mechanism includes an exit slot through the band compartment, and an elastic band having a first end and a second end, the first end being positioned within the band compartment, with the second end extends out through the exit slot. A first fastener element is positioned on the second end of the elastic band, and a second fastener element adapted to removably engage the first fastener element is attached to the glove body on the opposite side of the access slit from the exit slot. When the second fastener element is attached to the first fastener element the elastic band is positioned to traverse the access slit and constrict the opening of the glove body towards the closed configuration.

A primary objective of the present invention is to provide a glove having advantages not taught by the prior art.

Another objective is to provide a glove with a retractable closure mechanism that includes an elastic band that retracts from sight when not in use.

A further objective is to provide a glove that may be securely strapped to the user's hand while in use.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a glove adapted to be worn by a person on a hand and a wrist. The glove includes a closure mechanism that enables the glove to be securely fastened to the person's hand. The closure mechanism may also retract into the glove when not in use.

Figure 1:
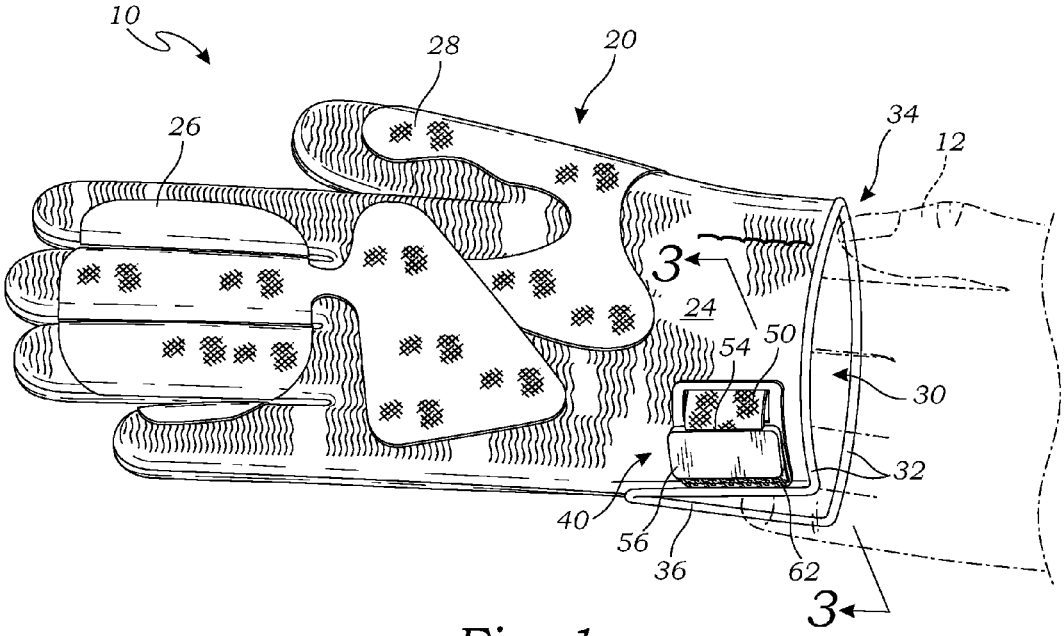
FIG. 1 is a perspective view of the glove according to one embodiment of the present invention, illustrating the glove when not being worn with the closure mechanism in a retracted configuration.
Figure 2:
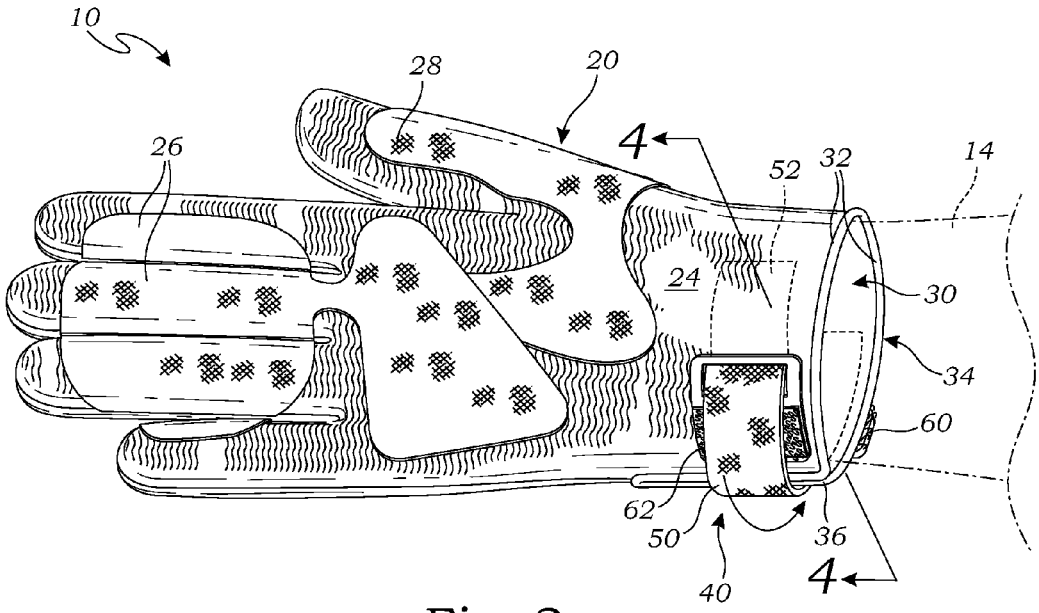
FIG. 2 is a perspective view of the glove being worn, illustrating the closure mechanism being used to fasten the glove on the user's hand.

FIG. 1 is a perspective view of the glove 10 when the glove 10 is not being worn, illustrating the closure mechanism 40 retracted from view. FIG. 2 is a perspective view of the glove 10 being worn, illustrating the closure mechanism 40 being used to fasten the glove 10 on the user's hand 12. As shown in FIGS. 1 and 2, the glove 10 includes a glove body 20 having a palm portion 22, a back portion 24, finger portions 26, and a thumb portion 28, that together define an interior 30 of the glove body 20 that is shaped to fit the hand 12.

A cuff perimeter 32 defines an opening 34 for accessing the interior 30 of the glove body 20. An access slit 36 extends from the cuff perimeter 32 towards the finger portions 26 so that the opening 34 can expand from a closed configuration that fits firmly around the wrist 14 of the person, to an expanded configuration that is large enough to receive the hand 12 of the person therethrough and into the interior 30 of the glove body 20.

While one embodiment of the glove 10 is illustrated in FIGS. 1 and 2, the glove 10 may include a variety of alternative constructions. For example, the finger portions 26 and the thumb portion 28 may cover all of the user's fingers and thumbs, as illustrated, or it may cover only a portion of the fingers/thumb, or may merely include apertures through which the user's fingers and/or thumb are positioned. The palm portion 22 and the back portion 24 may include apertures or mesh portions (not shown) for ventilation, padded portions (not shown) for protection, and any other of a variety of features known in the art of glove 10 construction. Such alternatives should be considered within the scope of the present invention.

Figures 3, 4:
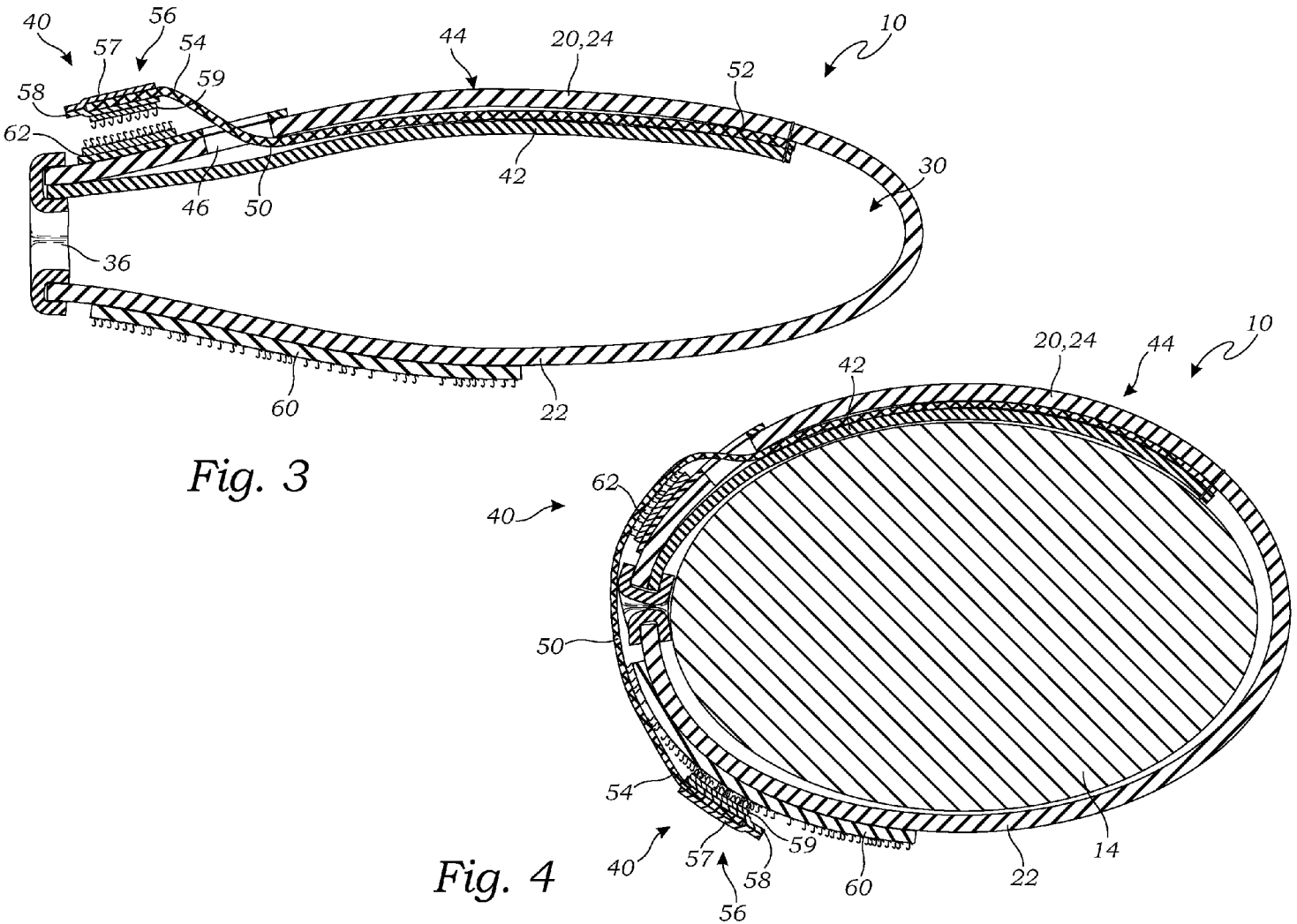
FIG. 3 is a sectional view thereof taken along line 3-3 in FIG. 1.
FIG. 4 is a sectional view thereof taken along line 4-4 in FIG. 2.

FIG. 3 is a sectional view thereof taken along line 3-3 in FIG. 1. FIG. 4 is a sectional view thereof taken along line 4-4 in FIG. 2. As illustrated in FIGS. 3 and 4, the glove 10 includes an inner layer 42 adjacent the glove body 20 and the glove 10 perimeter, such that the inner layer 42 and the glove body 20 together form a band compartment 44. While the inner layer 42 is illustrated as being positioned between the user's hand 12 and the glove body 20, the term "inner" should be broadly construed to include other arrangements that form the band compartment 44, including outside of the glove body 20 (a reversal of the illustrated embodiment), and other alternative arrangements that may be devised by those skilled in the art.

The closure mechanism 40 of the glove 10 further includes an exit slot 46 through the band compartment 44. The exit slot 46 is through either the glove body 20 or the inner layer 42, and may be positioned parallel to and spaced from the access slit 36. The exit slot 46 should be large enough for an elastic band 50 to fit through, as discussed in greater detail below.

The elastic band 50 has a first end 52 and a second end 54, the first end 52 being attached to the band compartment 44, preferably the glove body 20, such that the elastic band 50 is positioned within the band compartment 44, with the second end 54 extending out through the exit slot 46. A first fastener element 56 is positioned on the second end 54 of the elastic band 50, and a second fastener element 60 is attached to the glove body 20 on the opposite side of the access slit 36 from the exit slot 46. The first and second fasteners 56 and 60 are adapted to removably engage each other such that when the second fastener element 60 is attached to the first fastener element 56 the elastic band 50 traverses the access slit 36 and constricts the opening 34 of the glove body 20 towards the closed configuration.

In the illustrated embodiment, the first fastener element 56 is larger than the exit slot 46, so that the elastic band 50 cannot completely retract into the band compartment 44. The first and second fasteners 56 and 60 are illustrated as hooks and loops fasteners (i.e., Velcro®), but may be formed of any fastener devices or elements known in the art (e.g., snaps, hooks, etc.).

As illustrated in FIGS. 1 and 3, the elastic band 50 is elastically biased towards a retracted configuration wherein the elastic band 50 is substantially refracted within the band compartment 44, except for the first fastener element 56 which cannot pass through the exit slot 46, when the first and second fastener elements 56 and 60 are disengaged. In this manner the elastic band 50 does not hang from the glove body 20 in an obtrusive way and get tangled with other bands or straps that may be adjacent the glove 10. Furthermore, the glove 10 may also include a third fastener element 62 positioned between the exit slot 46 and the access slit 36, so that the first fastener element 56 may be removably attached to the third fastener element 62 when the elastic band 50 is in the retracted configuration. The third fastener element 62, preferably also hooks and loops fastener (such as Velcro®), further secures the elastic band 50, and prevents any tangling, unsightly dangling, and indeed makes the closure mechanism 40 completely unobtrusive.

In the present embodiment, the first fastener element 56 includes a top sheet 57 and a bottom sheet 58, which may be constructed of a suitable material such as plastic, rubber, leather, suitable fabric, or other material known to those skilled in the art. The top sheet 57 is bonded or otherwise fastened to the bottom sheet 58, with the second end 54 of the elastic band 50 sandwiched between the top and bottom sheets 58. A sheet of hooks and loops fastener material 59, or other suitable fastener element or material, may be bonded or otherwise fastened to the bottom sheet 58. The top and bottom sheets 57 and 58 are cut to be significantly larger than the second end 54 of the elastic band 50, so that while the elastic band 50 fits through the exit slot 46, the top and bottom sheets 57 and 58 do not.

In one embodiment, the exit slot 46 is substantially parallel to the access slit 36, and the access slit 36 is substantially perpendicular to the cuff perimeter 32. The glove 10 may further comprise a semi-ridged reinforcement element 64 attached to the glove body 20 and positioned around the exit slot 46. The third fastener element 62 may be mounted on the semi-ridged reinforcement element 64. The semi-ridged reinforcement element 64 may be a planar feature constructed of a leather or leather-like material, and further functions to strengthen the exit slot 46 so that it is not damaged by the elastic band 50 during repeated use.

As illustrated in FIGS. 2 and 4, the elastic band 50 may be pulled from the band compartment 44 from the retracted configuration to an extended configuration. In the extended configuration, the elastic band 50 extends from the band compartment 44 and around the cuff perimeter 32 and across the access slit 36. When the elastic band 50 is attached to the glove body 20 via the first and second fastening elements 56 and 60, the elastic band 50 holds the opening 34 of the glove 10 in the closed configuration.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A glove adapted to be worn by a person on a hand and a wrist, the glove comprising:

a glove body having a palm portion and a back portion that together define an interior shaped to fit the hand;

a cuff perimeter defining an opening for accessing the interior of the glove body;

an access slit extending from the cuff perimeter to enable the opening to expand from a closed configuration to an expanded configuration;

an inner layer adjacent the glove body and the glove perimeter, the inner layer and the glove body together forming a band compartment;

an exit slot through the band compartment;

an elastic band having a first end and a second end, the first end being positioned within the band compartment, with the second end extending out through the exit slot;

a first fastener element on the second end of the elastic band;

a second fastener element adapted to removably engage the first fastener element, the second fastener element being attached to the glove body on the opposite side of the access slit from the exit slot, such that when the second fastener element is attached to the first fastener element the elastic band traverses the access slit and constricts the opening of the glove body towards the closed configuration; and wherein the exit slot is through the glove body, wherein the first fastener element is larger than the exit slot, and wherein the elastic band is elastically biased towards a retracted configuration wherein the elastic band is substantially refracted within the band compartment, except for the first fastener element which cannot pass through the exit slot, when the first and second fastener elements are disengaged.

2. The glove of claim 1, further comprising a semi-ridged reinforcement element attached to the glove body and positioned around the exit slot.

3. A glove adapted to be worn by a person on a hand and a wrist, the glove comprising:

a glove body having a palm portion, a back portion, finger portions, and a thumb portion, that together define an interior of the glove body that is shaped to fit the hand;

a cuff perimeter defining an opening for accessing the interior of the glove body;

an access slit extending from the cuff perimeter towards the finger portions so that the opening can expand from a closed configuration that fits firmly around the wrist of the person, to an expanded configuration that is large enough to receive the hand of the person therethrough and into the interior of the glove body;

an inner layer covering at least part of the glove body adjacent the cuff perimeter and the access slit, forming a band compartment between the inner layer and the glove body;

an exit slot through the glove body;

an elastic band having a first end and a second end, the first end being attached to the glove body such that the elastic band is positioned within the band compartment, with the second end extending out through the exit slot;

a first fastener element on the second end of the elastic band;

a second fastener element adapted to removably engage the first fastener element, the second fastener element being attached to the glove body on the opposite side of the access slit from the exit slot, such that when the second fastener element is attached to the first fastener element the elastic band traverses the access slit and constricts the opening of the glove body towards the closed configuration;

wherein the first fastener element is larger than the exit slot, such that when the elastic band is elastically retracted towards a retracted configuration wherein the elastic band is substantially retracted within the band compartment, the first fastener element cannot pass through the exit slot; and a third fastener element positioned between the exit slot and the access slit, so that the first fastener element may be removably attached to the third fastener element when the elastic band is in the retracted configuration.

4. A glove adapted to be worn by a person on a hand and a wrist, the glove comprising:

a glove body having a palm portion and a back portion that together define an interior shaped to fit the hand;

a cuff perimeter defining an opening for accessing the interior of the glove body;

an access slit extending from the cuff perimeter to enable the opening to expand from a closed configuration to an expanded configuration;

an inner layer adjacent the glove body and the glove perimeter, the inner layer and the glove body together forming a band compartment;

an exit slot through the band compartment;

an elastic band having a first end and a second end, the first end being positioned within the band compartment, with the second end extending out through the exit slot;

a first fastener element on the second end of the elastic band;

a second fastener element adapted to removably engage the first fastener element, the second fastener element being attached to the glove body on the opposite side of the access slit from the exit slot, such that when the second fastener element is attached to the first fastener element the elastic band traverses the access slit and constricts the opening of the glove body towards the closed configuration; and a third fastener element positioned between the exit slot and the access slit, so that the first fastener element may be removably attached to the third fastener element when the elastic band is in the retracted configuration.

* * * * *